US007674101B2

(12) United States Patent
Maeng

(10) Patent No.: US 7,674,101 B2
(45) Date of Patent: Mar. 9, 2010

(54) SLIDING VANE OF ROTORS

(76) Inventor: Hyuk-Jae Maeng, 203-1003 Keukdong Apt., Baickma Maeul, #739 Madoo-dong, Ilsan-gu, Goyang-shi, Kyungki-do 410-708 (KR)

( * ) Notice: Subject to any disclaimer, the term of this patent is extended or adjusted under 35 U.S.C. 154(b) by 0 days.

(21) Appl. No.: 12/086,718

(22) PCT Filed: Mar. 14, 2006

(86) PCT No.: PCT/KR2006/000918

§ 371 (c)(1),
(2), (4) Date: Jun. 17, 2008

(87) PCT Pub. No.: WO2007/081071

PCT Pub. Date: Jul. 19, 2007

(65) Prior Publication Data

US 2009/0010790 A1 Jan. 8, 2009

(30) Foreign Application Priority Data

Jan. 16, 2006 (KR) ..... 10-2006-004385

(51) Int. Cl.
*F03C 4/00* (2006.01)
*F04C 18/00* (2006.01)

(52) U.S. Cl. ..... 418/258; 418/178; 418/253; 418/255

(58) Field of Classification Search ..... 418/253–255, 418/257, 258, 178
See application file for complete search history.

(56) References Cited

U.S. PATENT DOCUMENTS 140,914 A * 7/1873 Grotz ..... 418/255

(Continued)

FOREIGN PATENT DOCUMENTS

JP 57146091 A * 9/1982 ..... 418/255

(Continued)

OTHER PUBLICATIONS

English-language abstract of Japanese Patent Publication No. JP 2004-285978, published Oct. 14, 2004, esp@cenet database.

(Continued)

*Primary Examiner*—Theresa Trieu
(74) *Attorney, Agent, or Firm*—Cooper & Dunham LLP

(57) ABSTRACT

The present invention provides a sliding vane, which is provided through a rotor in a cylinder and reciprocates in a diametrical direction and rotates together with the rotor. The sliding vane of the present invention includes a vane body (10), which has plate seating slots (23*a*) and (23*b*) formed in the respective diametrical opposite ends of the vane body. The sliding vane further includes two pairs of compression plates (3*a*) and (3*b*), (3*c*) and (3*d*), which are provided in the plate seating slots. First springs (15) are provided in a diametrically inner end of each compression plate. A sealing rod insertion slot (7*a*), (7*b*), (7*c*), (7*d*) is formed in a diametrically outer end of each compression plate, and a second spring (19) is provided between axially inner ends of the adjacent compression plates. The sliding vane further includes a sealing rod (5*a*), (5*b*) which is inserted into and occupies the entire length of the sealing rod insertion slots of adjacent compression plates placed in each plate seating slot.

3 Claims, 5 Drawing Sheets

U.S. PATENT DOCUMENTS

| | | | | | |
|---|---|---|---|---|---|
| 393,620 | A | * | 11/1888 | Conver et al. | 418/255 |
| 1,972,744 | A | * | 9/1934 | Lister | 418/255 |
| 3,437,079 | A | * | 4/1969 | Daisaku | 418/111 |
| 4,385,873 | A | | 5/1983 | Richter | |
| 4,515,123 | A | | 5/1985 | Taylor | |
| 5,224,850 | A | * | 7/1993 | Pie | 418/111 |
| 6,189,502 | B1 | * | 2/2001 | Lai | 418/258 |
| 7,059,843 | B1 | * | 6/2006 | Badgley | 418/258 |

FOREIGN PATENT DOCUMENTS

| | | | |
|---|---|---|---|
| JP | 59168292 | | 9/1984 |
| JP | 2004-285978 | | 10/2004 |
| JP | 2004-332697 | | 11/2004 |
| KR | 20060099564 | A * | 9/2006 |

OTHER PUBLICATIONS

English-language abstract of Japanese Patent Publication No. JP2004-332697, published Nov. 25, 2004, esp@cenet database.

English-language abstract of Japanese Patent Publication No. JP 59-168292, published Sep. 21, 1984, esp@cenet database.

* cited by examiner

【Fig. 1】
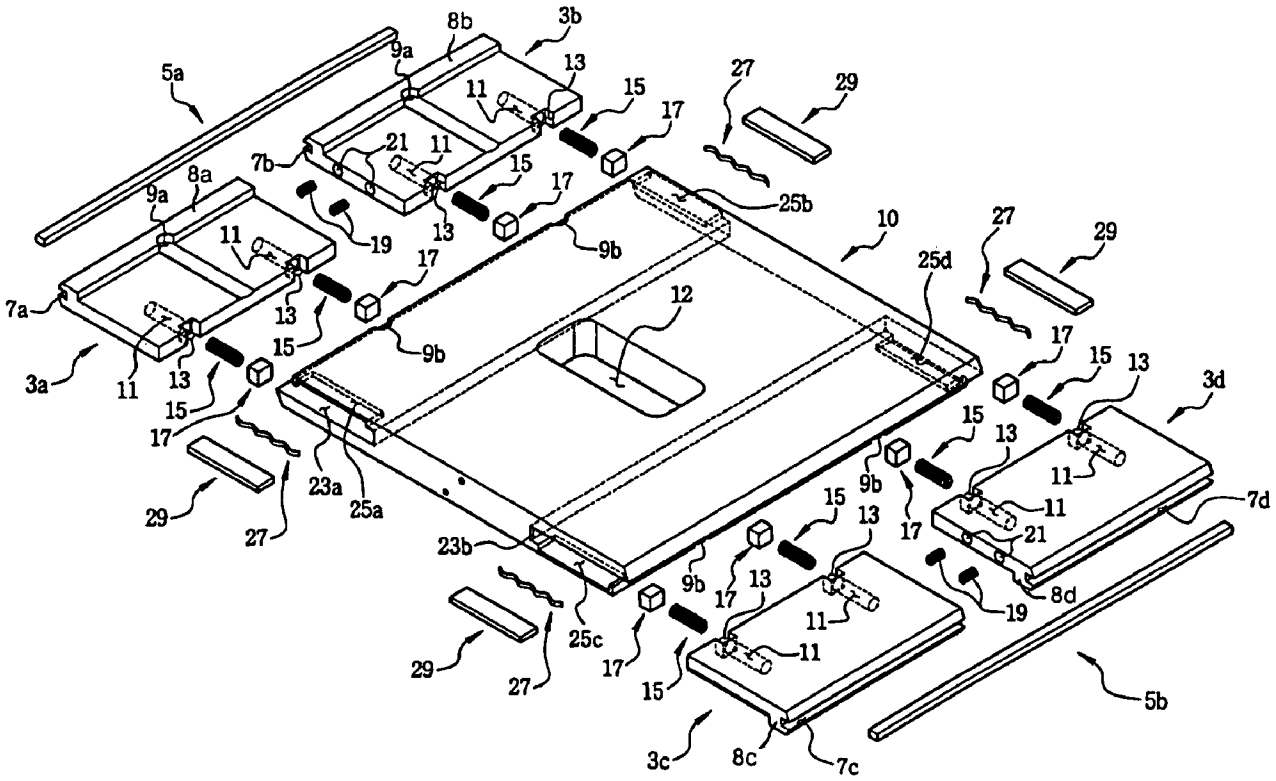
【Fig. 2】
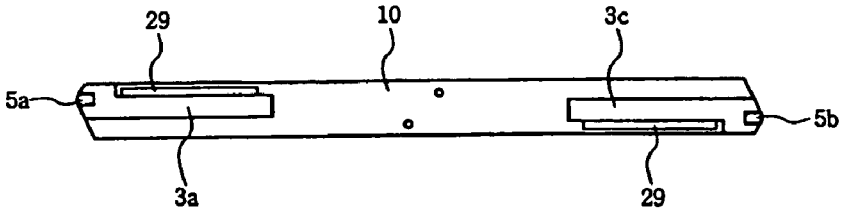

【Fig. 3】
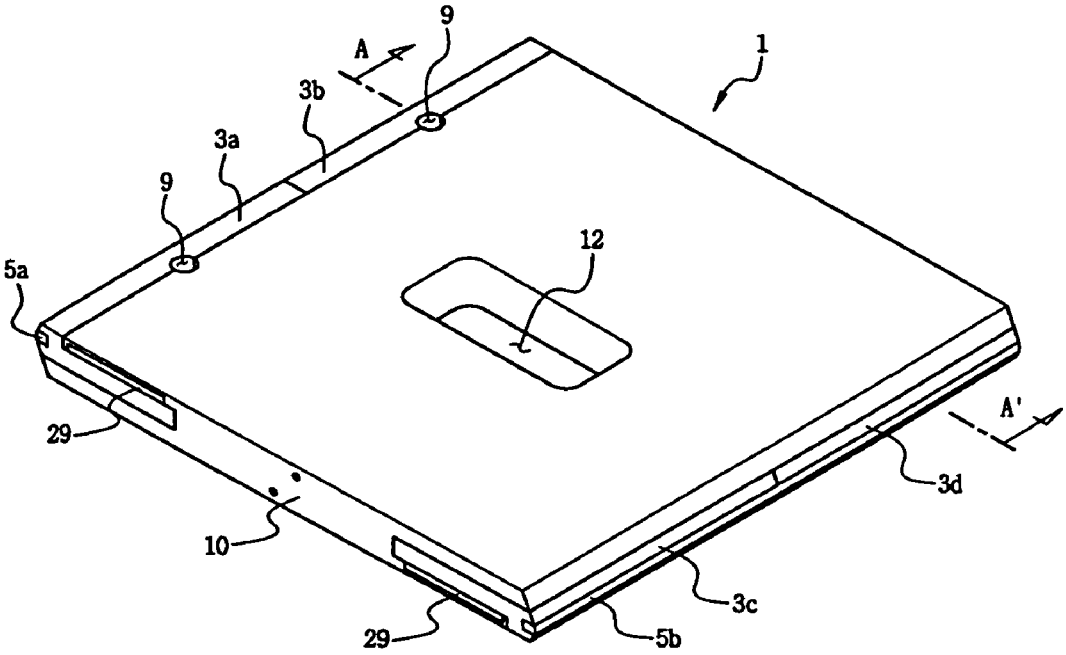
【Fig. 4】
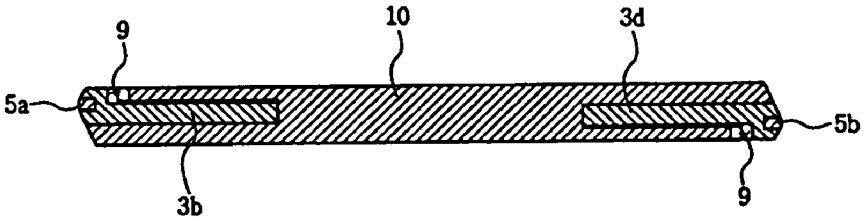

【Fig. 5】
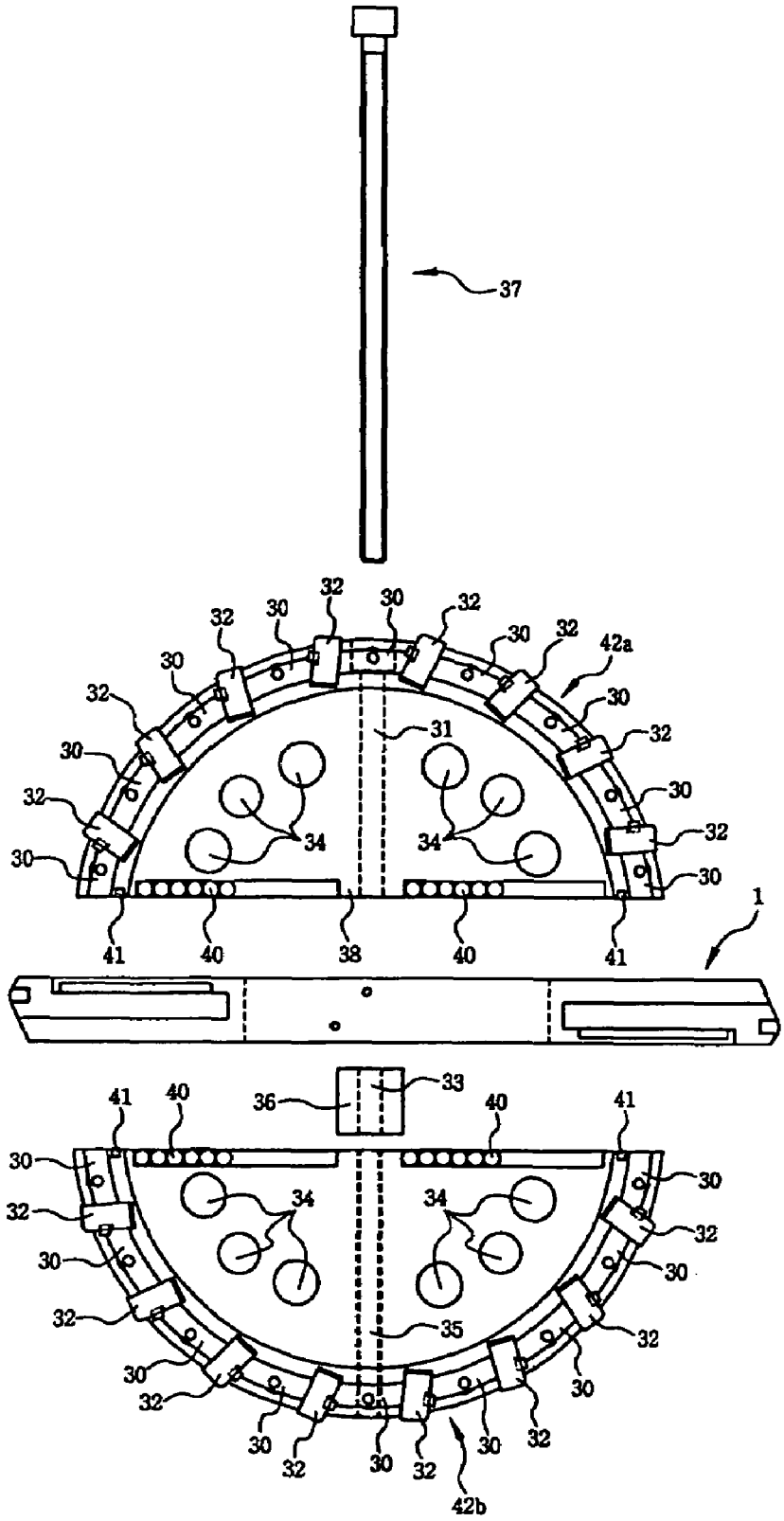

【Fig. 6】
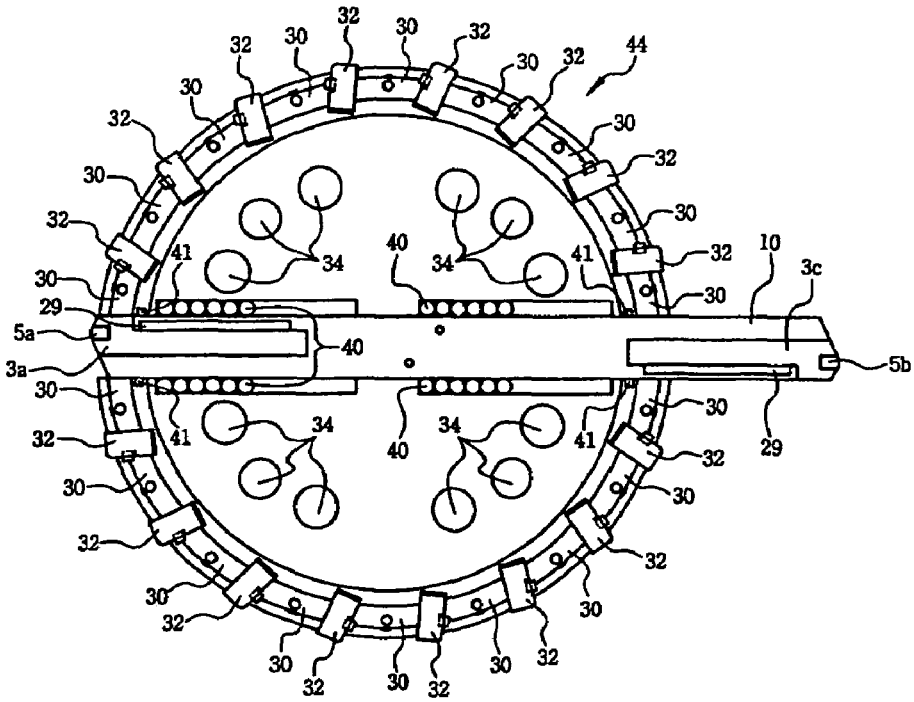

【Fig. 7】
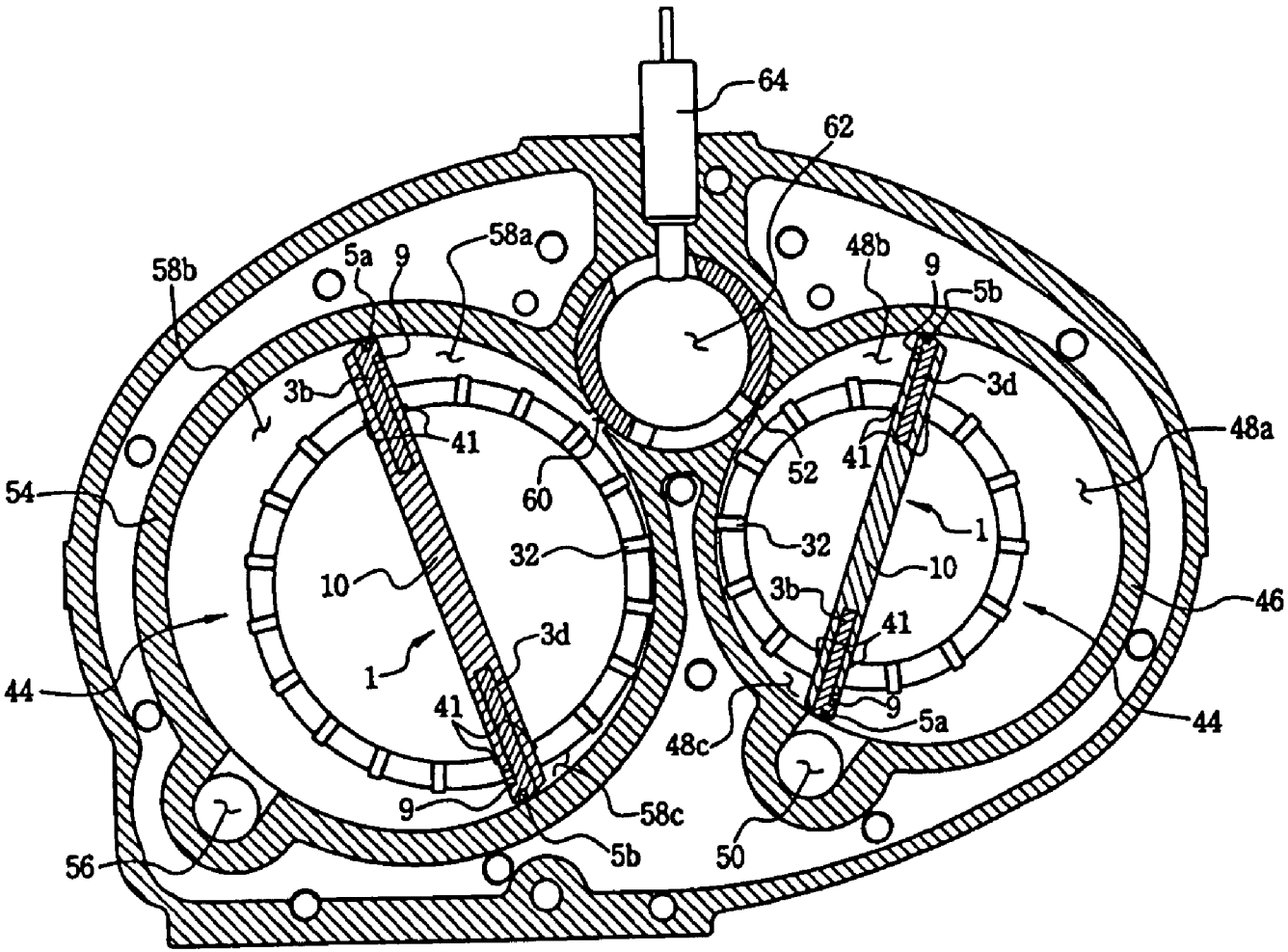

SLIDING VANE OF ROTORS

TECHNICAL FIELD

The present invention relates, in general, to sliding vanes for rotors and, more particularly, to a sliding vane which is provided so as to diametrically cross a central axis of a rotor, which is eccentrically installed a cylinder of a rotary engine or a compressor, so that, when the rotor rotates, the sliding vane diametrically reciprocates and partitions the interior space of the cylinder while maintaining airtightness between the partitioned spaces.

BACKGROUND ART

The inventor of the present invention proposed a rotary engine, which has an improved structure to solve the disadvantages experienced with conventional engines, such as wankel engines, etc., and was disclosed in Korean Patent Application No. 10-2005-20840 (Application Date: Mar. 14, 2005). The rotary engine of Korean Patent Application No. 10-2005-20840 comprises an engine body. The engine body includes a compression cylinder, which is configured to have a slightly distorted cylinder shape (an elliptical cylinder shape) and has at a predetermined position thereof an intake hole, through which fuel/air mixture or air is drawn into the compression cylinder. The engine body further includes an output cylinder, which has a slightly distorted cylinder shape (an elliptical cylinder shape) and is formed through the engine body in a direction parallel to the compression cylinder. A discharge hole, through which combustion gas is discharged, is formed at a predetermined position in the output cylinder. The engine body further includes a combustion chamber, which is formed between the compression cylinder and the output cylinder in a direction parallel both to the compression cylinder and to the output cylinder. The combustion chamber is divided into two cylindrical bores, which are symmetrical to each other, and each of which communicates with the compression cylinder through an intake gate and communicates with the output cylinder through a discharge gate. The rotary engine further comprises a compression rotor, which is eccentrically provided in the compression cylinder of the engine body and rotates such that fuel/air mixture or air is drawn into the compression cylinder through the intake hole, compressed, and supplied into the combustion chamber through the intake gates. The rotary engine further comprises an ignition device, which is provided in the combustion chamber of the engine body to ignite and explode the fuel/air mixture or air compressed and supplied by the compression rotor, and an output rotor which is eccentrically disposed in the output cylinder of the engine body and rotated using propulsive force generated by the combustion gas supplied from the compression cylinder through the discharge gates. The rotary engine further comprises a plurality of valves, which are provided in respective bores of the combustion chamber and control the intake gates and the discharge gates such that a compression process, a combustion process and an output process are sequentially conducted depending on rotational positions of the compression rotor and the output rotor. The rotary engine further comprises a synchronizing means, which rotates the compression rotor in conjunction with rotation of the output rotor, and an axial sealing means, which seals the compression cylinder, the combustion chamber and the output cylinder of the engine body. The present invention relates to a sliding vane to be used in a compression rotor and an output rotor which are components of the rotary engine of Korean Patent Application No. 10-2005-20840.

Airtightness is a critical requirement to ensure the practicability of Korean Patent Application No. 10-2005-20840. Particularly, it is very important to ensure airtightness between the inner surfaces of the compression and output cylinders and the sliding vanes of the compression rotor and the output rotor, and airtightness between the axially opposed ends of the sliding vanes and the covers (in the case that a sealing plate is provided inside each cover, airtightness with sealing plates, and, hereinafter, both the cover and the sealing plate, are abbreviated as "cover").

It is also important to ensure airtightness between the covers and the bodies of the compression rotor and the output rotor, but means for achieving these will be declared in another patent to be filed by the inventor of the present invention.

If airtightness between the inner surface of the compression cylinder and the sliding vane of the compression rotor and airtightness between the inner surface of the output cylinder and the sliding vane of the output rotor are not ensured, in the compression cylinder, some high-pressure fuel/air mixture or air may not be supplied from the compression cylinder into the combustion chamber but may leak into the intake hole, and, in the output cylinder, some high-pressure combustion gas may not be used for rotating the output rotor due to leakage thereof into the discharge hole. In this case, it is obvious that the efficiency of the rotary engine will be markedly reduced.

Furthermore, if airtightness between the covers and the axially opposite ends of the sliding vane is not ensured, in the compression cylinder, some high-pressure mixture or air may not be supplied from the compression cylinder into the combustion chamber, but may leak into the intake hole, and, in the output cylinder, some high-pressure combustion gas may not be used for rotating the output rotor but may be directly discharged through the discharge hole. In this case, it is obvious that the efficiency of the rotary engine will be markedly reduced.

DISCLOSURE OF INVENTION

Technical Problem

Accordingly, the present invention has been made keeping in mind the above problems occurring in the prior art, and an object of the present invention is to provide a sliding vane for a rotor which ensures airtightness between it and an inner surface of a compression cylinder or an output cylinder, thus markedly increasing the efficiency of an engine.

Another object of the present invention is to provide a sliding vane for a rotor which ensures airtightness between axially opposite ends thereof and cylinder covers, thus markedly increasing the efficiency of the engine.

Technical Solution

In order to accomplish the above object(s), the present invention provides a sliding vane provided through a rotor, which is eccentrically installed in a cylinder, so as to cross a central axis of the rotor, the sliding vane reciprocating in a diametrical direction of the rotor and rotating together with the rotor, while diametrically opposite ends thereof contact an inner surface of the cylinder and axially opposite ends thereof contact respective covers of the cylinder. The sliding vane includes: a vane body, having a rectangular planar shape, with a spacer formed at a central position through the vane body and extending in a direction, in which the sliding vane reciprocates, and a plurality of plate seating slots, each having a predetermined depth towards a central axis of the vane body, and formed in respective diametrical opposite ends of the vane body, the plate seating slots being symmetrical based on the central axis of the vane body; two pairs of compression plates, each having a rectangular planar shape, provided in the respective plate seating slots, with a plurality of first springs provided in a diametrically inner end of each of the compression plates to provide a pushing force in a direction of the inner surface of the cylinder, a sealing rod insertion slot formed in a diametrically outer end of each of the compression plates, and a second spring provided between axially inner ends of the adjacent compression plates to provide a pushing force in directions of the covers; and a sealing rod inserted throughout an entire length of the sealing rod insertion slots of the adjacent compression plates placed in each of the plate seating slots, the sealing rod having surface hardness and strength greater than surface hardness and strength of the compression plate.

Preferably, a pneumatic pressure guide groove may be formed in a surface of each of the compression plates so that high-pressure gas in the cylinder is supplied to the diametrically inner end of the compression plate between the first springs, and a pressure leakage prevention member may be provided between each of the first spring and an inner surface of the plate seating slot, so that the high-pressure gas, supplied between the diametrically inner end of the compression plate and the inner surface of the plate seating slot through the pneumatic pressure guide groove, is prevented from leaking in axial directions.

The sliding vane may further include: a sealing member seat, having a rectangular parallelepiped shape, formed in each of axially opposite ends of the plate seating slots such that the sealing member seat faces the surface of each compression plate in which the pneumatic pressure guide groove is formed; a sealing member, having a rectangular parallelepiped shape, placed in each of the sealing member seats; and a third spring installed in each of the sealing member seats and pushing the sealing member in a direction of a corresponding cover of the cylinder.

ADVANTAGEOUS EFFECTS

As described above, a sliding vane for a rotor used in a rotor engine or a compressor makes it possible to ensure airtightness between the sliding vane and an inner surface of a compression cylinder or of an output cylinder and to ensure airtightness between the axially opposite ends of the sliding vane and cylinder covers. Therefore, because a compression process and an output process can be conducted without pressure leakage, the present invention is advantageous in that the efficiency of the rotor engine or the compressor is markedly increased.

BRIEF DESCRIPTION OF THE DRAWINGS

FIG. 1 is an exploded perspective view of a sliding vane for a rotor, according to the present invention;

FIG. 2 is a front view of the sliding vane according to the present invention;

FIG. 3 is a perspective view of the sliding vane according to the present invention;

FIG. 4 is a sectional view taken along line A-A' of FIG. 3;

FIG. 5 is an exploded view showing the sliding vane and a rotor body of the rotor according to the present invention;

FIG. 6 is a front view of the rotor assembled with the sliding vane according to the present invention; and FIG. 7 is a view showing the usage of the rotor having the sliding vane according to the present invention.

BEST MODE FOR CARRYING OUT THE INVENTION

Hereinafter, a preferred embodiment of a sliding vane for rotors according to the present invention will be described in detail with reference to the attached drawings.

FIG. 1 is an exploded perspective view of a sliding vane for a rotor, according to the present invention. FIG. 2 is a front view of the sliding vane. FIG. 3 is a perspective view of the sliding vane. FIG. 4 is a sectional view taken along line A-A' of FIG. 3. FIG. 5 is an exploded view showing the sliding vane and a rotor body of the rotor. FIG. 6 is a front view of the rotor assembled with the sliding vane of the present invention. FIG. 7 is a view showing the usage of the rotor having the sliding vane of the present invention.

First, the usage of the sliding vane 1 for the rotor 44 according to the present invention will be explained herein below with reference to FIG. 7.

In the rotary engine shown in FIG. 7, an intake hole 50, through which mixture (air mixed with fuel) or air is drawn, and an intake gate 52, which communicates with a combustion chamber 62, are formed at predetermined positions in a compression cylinder 46. The compression rotor 44 rotates in the compression cylinder 46, thereby drawing fuel/air mixture or air into the compression cylinder 46 through the intake hole 50, compressing it, and supplying it into the combustion chamber 62 through the intake gate 52. Furthermore, in an output cylinder 54 of the rotary engine of FIG. 7, a discharge gate 60, through which high-pressure combustion gas is supplied from the combustion chamber 62 into the output cylinder 54, and a discharge hole 56, through which the combustion gas, having rotated the output rotor 44 in the output cylinder 54, is discharged outside the engine, are formed. The output rotor 44 of the output cylinder 54 is rotated by the combustion gas, which has been ignited by an ignition device 64 in the combustion chamber 62. Furthermore, the output rotor 44 discharges combustion gas through the discharge hole 56 once every half-rotation thereof. Meanwhile, front and rear ends of the compression cylinder 46 and the output cylinder 54 are covered with covers (not shown), such that open opposite ends of a compression chamber 48*a*, 48*b* and 48*c* and an output chamber 58*a*, 58*b* and 58*c* are sealed by the covers. The construction of each cover was described in detail in the abovementioned art disclosed in Korean Patent Application No. 10-2005-20340, therefore further explanation is deemed unnecessary.

As shown in FIG. 7, the rotors 44 are respectively provided in the compression cylinder 46 and the output cylinder 54 at positions eccentric in the direction of the combustion chamber 62. The main body of each rotor 44 respectively contacts the inner surface of each of the compression cylinder 46 and the output cylinder 54 at positions eccentric towards each other. Furthermore, the sliding vane 1 of the present invention is provided in each rotor 44 and diametrically crosses the central axis of the rotor 44. The sliding vane 1 rotates together with the rotor 44 and, simultaneously, reciprocates in a diametrical direction.

Therefore, in a process of compressing and supplying fuel/air mixture or air into the combustion chamber 62 using rotation of the rotor 44 in the compression cylinder, the interior space of the compression cylinder 46 is divided into three sections 48*a*, 48*b* and 48*c*, other than the case in which the sliding vane 1 is in a horizontal orientation. Among the three sections 48*a*, 48*b* and 48*c*, the section 48*b*, in which fuel/air mixture or air is compressed at high pressure, is closed by a junction between the body of the rotor 44 and the inner surface of the compression cylinder 46, a junction between a diametrical end of the sliding vane 1 and the inner surface of the compression cylinder 46, junctions between the body of the rotor 44 and the covers, and junctions between the axially opposite ends of the sliding vane 1 and the covers, other than the intake gate 52. Therefore, to compress fuel/air mixture or air, having been drawn into the compression cylinder 46 through the intake hole 50, at sufficiently high pressure, it is very important to ensure airtightness between the body of the rotor 44 and the inner surface of the compression cylinder 46, between the body of the rotor 44 and the cylinder covers, between the diametrical end of the sliding vane 1 and the inner surface of the compression cylinder 46, and between the axially opposite ends of the sliding vane 1 and the cylinder covers.

Furthermore, in a process of rotating the rotor 44 in the output cylinder 54 using the explosive power of the high-pressure combustion gas discharged from the combustion chamber 62, the interior space of the output cylinder 54 is divided into three sections 58*a*, 58*b* and 58*c*, other than the case in which the sliding vane 1 is in a horizontal orientation. Among the three sections 58*a*, 58*b* and 58*c*, the section 58*a*, into which high-pressure combustion gas is supplied, is closed by the junction between the body of the rotor 44 in the output cylinder 54 and the inner surface of the output cylinder 54, the junction between a diametrical end of the sliding vane 1 and the inner surface of the output cylinder 54, junctions between the body of the rotor 44 in the output cylinder 54 and the covers, and junctions between the axially opposite ends of the sliding vane 1 and the covers, other than the discharge gate 60. Therefore, in order to efficiently convert the explosive power of high-pressure combustion gas, which is supplied into the output cylinder 54 through the discharge gate 60, into rotating force, it is very important to ensure airtightness between the body of the rotor 44 in the output cylinder 54 and the inner surface of the output cylinder 54, between the body of the rotor 44 in the output cylinder 54 and the cylinder covers, between the diametrical end of the sliding vane 1 and the inner surface of the output cylinder 54, and between the axially opposite ends of the sliding vane 1 and the cylinder covers.

Referring to FIG. 1, the sliding vane 1 of the present invention is characterized in that a cylinder-wall-side sealing means, which is in close contact with the inner surface of the cylinder, is provided on each diametrical end of a vane body 10 of the sliding vane 1, and a cover-side sealing means, which is in close contact with each cylinder cover, is provided on each axial end of the vane body 10. The cylinder-wall-side airtightness is realized by sealing rods 5*a* and 5*b*, compression plates 3*a*, 3*b*, 3*c* and 3*d*, springs 15, pressure leakage prevention members 17, and high-pressure gas, which is supplied through pneumatic pressure guide grooves 9*a* formed on the surfaces of the respective compression plates 3*a*, 3*b*, 3*c* and 3*d*. The cover-side airtightness is realized by the compression plates 3*a*, 3*b*, 3*c* and 3*d*, springs 19, sealing members 29, and springs 27.

Thanks to the above-mentioned construction, the sliding vane 1 of the present invention, which rotates along with the rotor in the cylinder 46, 54 and diametrically reciprocates with respect to the rotor, can maintain airtightness between diametrically opposite edges thereof and the inner surface of the cylinder and airtightness between the axially opposite edges thereof and the cylinder covers.

As shown in FIG. 1, a spacer hole 12, which extends in the direction in which the sliding vane 1 reciprocates, is formed at a central position through the vane body 10 having a rectangular plate shape. Furthermore, plate seating slots 23*a* and 23*b*, into which the compression plates 3*a*, 3*b*, 3*c* and 3*d* are inserted, are formed in the diametrical opposite ends of the vane body 10. The plate seating slots 23*a* and 23*b* are symmetrical based on the central axis of the vane body 10. Each plate seating slot 23*a*, 23*b* has a predetermined depth towards the central axis of the vane body 10. Furthermore, two compression plates 3*a* and 3*b*, 3*c* and 3*d* are placed in each plate seating slot 23*a*, 23*b* such that they are adjacent to each other. The springs 15 are provided in a diametrically inner end of each compression plate 3*a*, 3*b*, 3*c*, 3*d*, thus pushing the compression plate 3*a*, 3*b*, 3*c*, 3*d* in the direction of the inner surface of the cylinder. That is, the cylinder-wall-side airtightness is ensured by the elasticity of the springs 15. To prevent the springs 15 from moving, spring insertion holes 11 and insertion notches 13 for receiving pressure leakage prevention members are preferably formed in the diametrically inner end of each compression plate 3*a*, 3*b*, 3*c*, 3*d*. The springs 15 and the pressure leakage prevention members 17 are respectively inserted into the spring seating holes 11 and the insertion notches 13. The springs 15 are preferably coil springs, but are not limited to coil springs. As such, two compression plates 3*a* and 3*b*, 3*c* and 3*d* are placed in each plate seating slot 23*a*, 23*b* such that they are adjacent to each other. Here, the springs 19 are interposed between the axially inner ends of adjacent compression plates 3*a* and 3*b*, 3*c* and 3*d*, that is, between junction surfaces between adjacent compression plates 3*a* and 3*b*, 3*c* and 3*d*, thus pushing the compression plates 3*a*, 3*b*, 3*c* and 3*d* in directions of the cylinder covers. Therefore, the cover-side airtightness is ensured by the elasticity of the springs 19.

Meanwhile, because two compression plates are placed in each plate seating slot 23*a*, 23*b*, if the diametrically outer ends of the compression plates contact the inner surface of the cylinder, pressure may leak through a gap defined between the compression plates and the inner surface of the cylinder. To prevent this, a sealing rod insertion slot 7*a*, 7*b*, 7*c*, 7*d*, which has a predetermined depth towards the central axis of the sliding vane 1, is formed in the diametrically outer end of each compression plate 3*a*, 3*b*, 3*c*, 3*d*, and each sealing rod 5*a*, 5*b*, which is relatively long, is inserted in to adjacent sealing rod insertion slots 7*a* and 7*b*, 7*c* and 7*d*. In detail, each sealing rod 5*a*, 5*b* has length sufficient to occupy the entire length of the sealing rod insertion slots 7*a* and 7*b*, 7*c* and 7*d* of the compression plates 3*a* and 3*b*, 3*c* and 3*d* which are placed in the same plate seating slot 23*a*, 23*b*. Furthermore, each sealing rod 5*a*, 5*b* has surface hardness and strength greater than those of the compression plates.

Furthermore, as shown in FIG. 1, a stepped part 8*a*, 8*b*, 8*c*, 8*d* is provided on the surface of the diametrically outer end of each compression plate 3*a*, 3*b*, 3*c*, 3*d*. Preferably, each plate seating slot 23*a*, 23*b* has a predetermined height such that parts of the compression plates 3*a*, 3*b*, 3*c* and 3*d*, other than the stepped parts 8*a*, 8*b*, 8*c* and 8*d*, can be tightly inserted into the plate seating slots 23*a* and 23*b*. Alternatively, each compression plate 3*a*, 3*b*, 3*c*, 3*d* may have no stepped part such that the thickness thereof is constant.

Meanwhile, a pneumatic pressure guide groove 9*a* is formed in each compression plate 3*a*, 3*b*, 3*c*, 3*d* and extends to the diametrically inner end of the compression plate 3*a*, 3*b*, 3*c*, 3*d*. Thus, high-pressure gas is supplied to the diametrically inner end of the compression plate 3*a*, 3*b*, 3*c*, 3*d* through the pneumatic pressure guide groove 9*a*, thus pushing the compression plate in the direction of the inner surface of the cylinder. As such, each pneumatic pressure guide groove 9*a* is formed in the surface of each compression plate 3*a*, 3*b*, 3*c*, 3*d*, so that high-pressure gas in the cylinder is supplied into a space defined by the diametrically inner end of the compression plate, the pressure leakage prevention members 17, and the inner surface of the plate seating slot 23*a*, 23*b*. Furthermore, the pressure leakage prevention members 17, which are disposed between the springs 15 and the inner surface of the plate seating slot 23*a*, 23*b*, prevent high-pressure gas, supplied through the pneumatic pressure guide groove 9*a*, from leaking between the compression plate 3*a*, 3*b*, 3*c*, 3*d* and the inner surface of the plate seating slot 23*a*, 23*b* in an axial direction. The airtightness provided using high-pressure gas supplied through the pneumatic pressure guide groove 9*a* is more reliable than airtightness provided using the springs 15. The springs 15 push the compression plates 3*a*, 3*b*, 3*c* and 3*d* in the direction of the inner surface of the cylinder, thus contributing to the realization of cylinder-wall-side airtightness. Also, the springs 15 serve to push the pressure leakage prevention members 17 inwards, that is, towards the inside surfaces of the plate seating slots 23*a* and 23*b*, thus preventing high-pressure gas from leaking in an axial direction.

Meanwhile, preferably, the two compression plates 3*a* and 3*b*, which are placed in the plate seating slot 23*a*, and the two compression plates 3*c* and 3*d*, which are placed in the plate seating slot 23*b*, are symmetrically oriented. The reason is that the roles of the compression plates 3*a* and 3*b* in the plate seating slot 23*a* and of the compression plates 3*c* and 3*d* in the plate seating slot 23*b* are exchanged with each other every half-rotation of the rotor, as shown in FIG. 7.

As shown in the drawings, pneumatic pressure guide notches 9*b* are formed in diametrically opposite edges of the vane body 10 at positions corresponding to the pneumatic pressure guide grooves 9*a* of the compression plates 3*a*, 3*b*, 3*c* and 3*d*. Thus, when the sliding vane 1 is assembled, each pneumatic pressure guide groove 9*a* and each pneumatic pressure guide notch 9*b* form a pneumatic pressure guide hole 9. Therefore, as shown in FIG. 7, when the pneumatic pressure guide holes 9 face the high-pressure compressed gas space 48*b* or the high-pressure combustion gas space 58*b*, high-pressure fuel/air mixture, air, or combustion gas can be easily supplied into the diametrically inner ends of the compression plates 3*a*, 3*b*, 3*c* and 3*d*.

Returning to FIG. 1, the cover-side airtightness of the sliding vane 1 of the present invention is realized by the springs 19, which are provided between the compression plates. To ensure cover-side airtightness more reliably, sealing members are provided in the axially opposite ends of the sliding vane 1. In detail, each sealing member seat 25*a*, 25*b*, 25*c*, 25*d*, having a rectangular parallelepiped shape, is formed in each of axially opposite ends of the plate seating slots 23*a* and 23*b* such that the sealing member seat 25*a*, 25*b*, 25*c*, 25*d* faces the surface of each compression plate 3*a*, 3*b*, 3*c*, 3*d*, in which the pneumatic pressure guide groove 9*a* is formed. Each sealing member 29, having a rectangular parallelepiped shape, is placed in each of the sealing member seats 25*a*, 25*b*, 25*c* and 25*d*. A spring 27 is installed in each sealing member seat 25*a*, 25*b*, 25*c*, 25*d* and pushes each sealing member 29 in the direction of the corresponding cover of the cylinder, thus more reliably ensuring cover-side airtightness. Here, it is preferable that the spring 27 be a leaf spring having a waved band shape, as shown in FIG. 1.

Referring to FIGS. 2 through 4, in the sliding vane 1 of the present invention having the above-mentioned construction, cylinder-wall-side airtightness is ensured by the sealing rods 5*a* and 5*b*, which are provided in diametrically outer ends of the compression plates 3*a*, 3*b*, 3*c* and 3*d* and are in close contact with the inner surface of the cylinder. Cover-side airtightness is ensured by the axially outer surfaces of the compression plates 3*a*, 3*b*, 3*c* and 3*d* and the axially outer surfaces of the sealing member 29 which are in close contact with the cylinder covers. Furthermore, as shown in FIG. 4 through 7, high-pressure gas is supplied into diametrically inner ends of the compression plates 3*a*, 3*b*, 3*c* and 3*d* through the pneumatic pressure guide holes 9 and pushes the compression plates 3*a*, 3*b*, 3*c* and 3*d* outwards, thus ensuring the cylinder-wall-side airtightness more reliably.

Referring to FIGS. 5 and 6, after a spacer 36, which defines and maintains a distance between two body units 42*a* and 42*b* of the rotor body, is inserted into the spacer hole 12 formed at a central position through the vane body 10, the sliding vane 1 and the spacer 36 are assembled with the two body units 42*a* and 42*b* using a locking bolt 37. For this, through holes 31 and 33 are respectively formed through the upper body unit 42*a* and the spacer 36, and a hole 35 is tapped at a predetermined position in the lower body unit 42*b*. Furthermore, hubs are coupled to respective opposite ends of the body units 42*a* and 42*b* of the rotor and the sliding vane 1 by tightening locking members into locking holes 34 of the rotor, thereby a rotor shaft and the like can be additionally coupled to the rotor. In FIGS. 5 and 6, the reference numeral 30 denotes a rotor body sealing member for ensuring airtightness between the rotor body and the cylinder cover, and the reference numeral 32 denotes a rotor body sealing rod for ensuring airtightness both between the rotor body and the inner surface of the cylinder and between the rotor body and the cylinder cover.

Referring to FIGS. 5 through 7, to ensure airtightness between the vane body 10 and the body units 42*a* and 42*b* of the rotor, a sealing rail 41, which extends a predetermined length in an axial direction, is preferably provided on each junction between the vane body 10 and the body units 42*a* and 42*b* of the rotor.

As shown in FIG. 7, thanks to the above-mentioned construction, even while the rotor 44 rotates at a high speed, the present invention makes it possible to ensure airtightness between the rotor body and the inner surface of the cylinder, airtightness between the rotor body and the cylinder covers, airtightness between the diametrically opposite ends of the sliding vane 1 and the inner surface of the cylinder, and airtightness between the axially opposite ends of the sliding vane 1 and the covers.

INDUSTRIAL APPLICABILITY

As described above, the present invention provides a sliding vane for a rotor used in a rotor engine or a compressor which makes it possible to ensure airtightness between the sliding vane and an inner surface of a compression cylinder or of an output cylinder and to ensure airtightness between the axially opposite ends of the sliding vane and cylinder covers. Therefore, because a compression process and an output process can be conducted without pressure leakage, the present invention is advantageous in that the efficiency of the rotor engine or the compressor is markedly increased.

Although the preferred embodiment of the present invention has been disclosed for illustrative purposes, the scope of the present invention is not limited to the preferred embodiment. Furthermore, those skilled in the art will appreciate that various modifications, additions and substitutions are possible, without departing from the scope and spirit of the invention as disclosed in the accompanying claims. Therefore, it must be appreciated that the scope of the present invention is defined by the accompanying claims.

The invention claimed is:

1. A sliding vane provided through a rotor, which is eccentrically installed in a cylinder, so as to cross a central axis of the rotor, the sliding vane reciprocating in a diametrical direction of the rotor and rotating together with the rotor, while diametrically opposite ends thereof contact an inner surface of the cylinder and axially opposite ends thereof contact respective covers of the cylinder, the sliding vane comprising:

a vane body, having a rectangular planar shape, with a spacer formed at a central position through the vane body and extending in a direction, in which the sliding vane reciprocates, and a plurality of plate seating slots, each having a predetermined depth towards a central axis of the vane body, and formed in respective diametrical opposite ends of the vane body, the plate seating slots being symmetrical based on the central axis of the vane body;

two pairs of compression plates, each having a rectangular planar shape, provided in the respective plate seating slots, with a plurality of first springs provided in a diametrically inner end of each of the compression plates to provide a pushing force in a direction of the inner surface of the cylinder, a sealing rod insertion slot formed in a diametrically outer end of each of the compression plates, and a second spring provided between axially inner ends of the adjacent compression plates to provide a pushing force in directions of the covers; and a sealing rod inserted throughout an entire length of the sealing rod insertion slots of the adjacent compression plates placed in each of the plate seating slots, the sealing rod having surface hardness and strength greater than surface hardness and strength of the compression plate.

2. The sliding vane according to claim 1, wherein a pneumatic pressure guide groove is formed in a surface of each of the compression plates so that high-pressure gas in the cylinder is supplied to the diametrically inner end of the compression plate between the first springs, and a pressure leakage prevention member is provided between each of the first spring and an inner surface of the plate seating slot, so that the high-pressure gas, supplied between the diametrically inner end of the compression plate and the inner surface of the plate seating slot through the pneumatic pressure guide groove, is prevented from leaking in axial directions.

3. The sliding vane according to claim 1, further comprising:

a sealing member seat, having a rectangular parallelepiped shape, formed in each of axially opposite ends of the plate seating slots such that the sealing member seat faces the surface of each compression plate in which the pneumatic pressure guide groove is formed;

a sealing member, having a rectangular parallelepiped shape, placed in each of the sealing member seats; and a third spring installed in each of the sealing member seats and pushing the sealing member in a direction of a corresponding cover of the cylinder.

* * * * *